US008100598B2

(12) United States Patent
Killion et al.

(10) Patent No.: US 8,100,598 B2
(45) Date of Patent: Jan. 24, 2012

(54) TWO-PIECE MAGNETICALLY ACTUATED PEN

(75) Inventors: Thomas Killion, Indianapolis, IN (US); Samuel Werth, Indianapolis, IN (US)

(73) Assignee: Thomas Killion, Indianapolis, IN (US)

( * ) Notice: Subject to any disclaimer, the term of this patent is extended or adjusted under 35 U.S.C. 154(b) by 366 days.

(21) Appl. No.: 12/317,860

(22) Filed: Dec. 30, 2008

(65) Prior Publication Data

US 2009/0175672 A1 Jul. 9, 2009

Related U.S. Application Data

(60) Provisional application No. 61/018,481, filed on Jan. 1, 2008.

(51) Int. Cl.
*B43K 24/02* (2006.01)
*B43K 5/16* (2006.01)
*B43K 7/12* (2006.01)

(52) U.S. Cl. ..... 401/100

(58) Field of Classification Search ..... 401/100, 401/88, 195

See application file for complete search history.

(56) References Cited

U.S. PATENT DOCUMENTS

| | | | | |
|---|---|---|---|---|
| 2,584,569 | A | 2/1952 | Frentzel | |
| 2,870,741 | A | 1/1959 | Kersten | |
| 2,978,723 | A | 4/1961 | Hopkins | |
| 3,063,419 | A * | 11/1962 | Parker | 401/100 |
| 4,168,129 | A | 9/1979 | Herrnring | |
| 4,176,979 | A | 12/1979 | Saida | |
| 4,381,158 | A | 4/1983 | Garganese | |
| 6,830,402 | B2 * | 12/2004 | Sunatori | 401/100 |
| 7,101,102 | B2 | 9/2006 | Sawa | |
| 7,226,229 | B1 | 6/2007 | Register | |
| 2006/0171762 | A1 | 8/2006 | Mayne | |
| 2008/0095568 | A1 | 4/2008 | Hsien | |
| 2008/0101847 | A1 | 5/2008 | Lapstun et al. | |

OTHER PUBLICATIONS www.4imprint.com; Promotional Products related with Lanyard, Dec. 10, 2008.

* cited by examiner

*Primary Examiner* — Tuan Nguyen
(74) *Attorney, Agent, or Firm* — E. Victor Indiano; Indino Law Group LLC.

(57) ABSTRACT

A magnetically actuated writing instrument includes a holder portion including a first magnetically attractive member. The instrument also includes a writing instrument portion having an interior and a second magnetically attractive member. The writing instrument portion includes a barrel having a distal end portion. The barrel member is movable between a retracted position wherein the distal end is disposed within the interior of the writing instrument portion, and an extended position wherein the distal portion is disposed exteriorly of the writing instrument portion. A retractor for moving the barrel between the retracted and extended positions includes the first and second magnetically attractive members. The presence of magnetic attraction between the first magnetically attractive member and the second magnetically attractive member causes the barrel to move toward the retracted position, and the absence of magnetic attraction between the first and second magnetically attractive members causes the barrel to move toward the extended position.

22 Claims, 7 Drawing Sheets

TWO-PIECE MAGNETICALLY ACTUATED PEN

I. PRIORITY CLAIM

The instant application claims benefit of priority to Werth and Killion, U.S. Provisional Patent Application Ser. No. 61/018,481 filed on 1 Jan. 2008, which provisional application is fully incorporated herein.

II. TECHNICAL FIELD OF THE INVENTION

The present invention relates to writing instruments, and more particularly, to writing instruments wherein the pen barrel is axially moveable between a retracted or storage position wherein the colorant dispensing member is positioned with a pen casing to prevent the colorant dispensing member from being exposed to surfaces that can be unintentionally stained by the ink; and an extended or writing position wherein the distal colorant dispensing member of the colorant containing barrel extends outwardly of the casing so that the colorant dispensing member may engage the writing surface and dispense colorant thereon. In addition to pens, the present invention has utility with a wide variety of writing instruments, including stylii of the type used commonly with touch-screen electronic devices, such as PDAs. As used in this application, the term "writing instrument" is to be construed broadly enough to include such styli

III. BACKGROUND OF THE INVENTION

Retractable writing instruments, and particularly retractable pens have existed for quite some time. The most common type of retractable pen includes a two-piece casing. The casing includes a top (proximal) portion and a bottom (distal) portion that are threadably joined together at the distal end of the top portion and the proximal end of the bottom portions. Encased within the interior of the pen casing is a generally cylindrical colorant containing member (often referred to as a barrel) that includes a proximal end and a distal end. In pens, the colorant usually comprises an ink material. A point or colorant (ink)-dispensing member such as a nib, felt-tip, ball point or gel dispenser is disposed at the distal end.

The proximal portion of the case may include a clip for enabling the user to affix the pen onto his pocket. A distal aperture is disposed at the distal end of the case. The colorant dispensing member containing distal end of the ink barrel is axially extendable through the distal aperture in the case as the pen moves between its retracted and the its extended, or writing position. A spring is provided that is disposed within the casing and is engaged to a proximal spring rest formed as a part of the barrel. In a typical retractable pen, the spring is designed so that it is biased to exert a proximally directed force against the proximal spring rest to thereby push the barrel in a proximal direction from the extended position to the retracted position.

A pen actuating mechanism is usually disposed at the proximal end of the top member of the case. The actuating mechanism often comprises a generally cylindrically shaped actuator member that is slidably received within a proximal aperture formed at the top (proximal end) of the proximal case member. The actuation member is coupled to a retractor lock. The retractor lock member is generally cylindrical, and extends from the actuator to the top or proximal end of the barrel. The retractor lock will often have a radially extending portion that includes flanges and ramps that engage with the cap portion so that the pen can be locked in both the retracted position and the extended position.

Probably the most wide-spread species of the spring actuated retractor pen described above is the so-called "duo-push" type of project-retract mechanism. The duo-push mechanism gets its name from the fact that consecutive depressions of the actuator that passes through the proximal opening are designed, alternately, to project and retract the colorant-dispensing point out of and back into the casing of the instrument. An example of such a duo-push retraction mechanism is shown in Frentzel, U.S. Pat. No. 2,584,569, that is assigned to the Parker Pen Company.

In addition to the duo-push mechanism, a variety of other retraction mechanisms exist. Some of these retraction mechanisms are "shake" actuated, while other are "gravity" actuated.

Another retraction extension mechanism operates by the rotation of a rotatable part about its axis that serves to axially move the ink-containing barrel between its extended and retracted position. Such rotation actuated mechanisms have been used for years in pens made by the Cross Pen Company, and are discussed in the background portion of Saida, U.S. Pat. No. 4,176,979. The Saida patent is interesting because it employs at least a pair of magnets within its retraction mechanism. See Saida, U.S. Pat. No. 4,176,979.

Other examples of a retraction mechanisms are shown in the prior art patents being submitted concurrently with the filing of this application.

Although many of the various retraction mechanisms perform their services in a workmanlike manner, room for improvement exists.

In particular, room for improvement exists in providing a retraction mechanism that is almost "automatic", and that can be easily actuated and moved between its extended and retracted position with one-handed operation.

Another feature that is found on many writing instruments is a "holder" type mechanism that enables the writing instrument to be held on to the user's person during those times when the instrument is not being held by the user's hand. Probably the most widely used of these holder mechanisms is a clip-type device that is designed to engage the material of the user's clothes between the clip and the pen barrel when the pen is attached to an article of a user's clothing, such as when the pen is placed in the user's shirt pocket or pant pocket.

Another holder-type mechanism comprises a lanyard. Lanyards generally comprise straps that are sized to be placed around a user's neck. Pens have been attached to lanyards so that the user can carry around the pen easily by placing the lanyard around his or her neck. An example of such a lanyard holder for a pen is the lanyard pen sold by IV Imprint, and can be seen at their website at www.ivimprint.com.

Other holder mechanisms that comprise telephone cord-like coiled members that can be placed around the user's wrist, and to which can be attached a pen mechanism.

One difficulty with the lanyard holder and the wrist holder described above relates to the use of the pen while on the holder. Unless the lanyard or wrist holder is unusually long, a user is often required to either remove the pen from the lanyard before writing, or to keep the pen on the lanyard, while removing the lanyard from the user's neck, before using the writing instrument.

It is therefore one object of the present invention to provide a writing instrument that can be easily coupled to, and decoupled from a holder member, such as a lanyard or wristband.

IV. SUMMARY OF THE INVENTION

In accordance with the present invention, a magnetically actuated writing instrument comprises a holder portion and a writing instrument portion. The holder portion includes a first magnetically attractive member. The writing instrument portion has an interior and a second magnetically attractive member; and a barrel having a distal end portion. The barrel member is movable between a retracted position wherein the distal end is disposed within the interior of the writing instrument portion, and an extended position wherein the distal portion is disposed exteriorly of the writing instrument portion. A retractor for moving the barrel between the retracted and extended positions includes the first and second magnetically attractive members. The presence of magnetic attraction between the first magnetically attractive member and the second magnetically attractive member causes the barrel to move toward the retracted position, and the absence of magnetic attraction between the first and second magnetically attractive members causes the barrel to move toward the extended position.

The holder portion may be a two piece member which includes a proximal end which may include an aperture or other gripping mechanism to which a lanyard can be attached. The lanyard can be preferably of a length so that it will extend around the user's neck. In use, the lanyard is extended around a user's neck, which places the pen, in an average person, somewhere close to the bottom of their sternum or rib cage.

As will be explained later, when the writing instrument portion of the pen is removed from the holder portion, the writing instrument can be moved to any surface the user wants to write upon. The writing instrument portion member can then be replaced back in engagement with the holder. When the writing instrument portion is removed from the holder member, the barrel is caused (as will be explained later) to move axially outwardly into the writing position, and is locked in the writing position so that writing can occur in view of the axially proximally directed forces being exerted on the barrel through its engagement with the writing member. When the writing instrument member is placed back in its storage position so that the writing instrument member is engaged with the holder, the magnet in the holder pulls the barrel into the retracted position so that the distal end of the barrel no longer extends outwardly from the distal end of the casing and is thereby sheltered to protect it from dispensing ink on the user's clothing.

One feature of the invention is that an inner magnet is inserted into a tube through an open distal end of the magnet tube, to thereby trap the magnet in the tube. By inserting the magnet into the open end of the tube and then encasing the magnet within the tube, the present invention achieves a better connection between the magnet and the tube, and overcomes the difficulties of getting the magnet to stay fixed in its proper place in the tube. Maintaining a magnet in a proper place in a plastic structure is difficult because of the difficulty of forming a good glue or epoxy bond between a magnet and a plastic part. By having the proximal end of the magnet tube closed, a receiver cup is formed for receiving the magnet that mechanically traps the magnet within the tube.

A further feature of the present invention is that it includes a side opening holes through which latch portions of locking legs extend. When the device is in the extended (writing) position (FIG. 4), the latches extend all the way through the side opening holes, to rest against the axially facing, radially extending shoulders to thereby prevent axially inward movement of the barrel, thereby maintaining the colorant dispensing point member exteriorly of the casing, and thereby in the writing position.

An additional feature of the present invention is the collection and arrangement of components that enable the device to move into its retracted position. As the device is moved into its retracted position, lower distal shelf ends of the apertures engage the radially outwardly facing angled surfaces of the latch-containing pivotable legs, which causes the proximal portions of the legs to pivot radially inwardly about a pivot member. The proximal portions will pivot radially inwardly until they reach a point as shown in the retracted figure wherein the lower axially distally facing surfaces of the latches engage the lower shelves of the apertures. This engagement then pulls the retractor base proximally against the biasing force of a spring so that it moves the ink barrel into the retraced position.

Another feature of the present invention is the pivot stud. The stud is a pivot point around which the two legs pivot. It should further be noted that the legs include a groove into which an o-ring fits. The o-ring serves as a rubber band to hold the legs into engagement with the studs. The o-ring exerts radially inwardly directed pressure (just like any tight rubber band) on the lower portion of the legs. The o-ring thereby causes the lower (distal) portions of the legs to pivot inwardly which causes the upper (proximal) portions of the legs near the latches to pivot outwardly. Therefore, the o-ring exerts pressure which causes the proximal ends of legs to move radially outwardly so that the latches engage the relatively radially outwardly positioned shoulder and also keep the latches engaged with the proximal shelves of apertures.

An additional feature of the preferred embodiment of the present invention is that an internal magnet tube is provided that includes first and second ramped or beveled surfaces. These ramped and beveled surfaces provide a surface on which the proximal ends of the pivotal locking legs will move radially inwardly, which aids the assembly procedure by enabling the legs to more easily move axially within the tube so that they can move to their assembled position. In the assembled position the distal end latches are at the same axial position as the apertures so that the latches extend either partially or fully through apertures.

Another feature of the present invention resides in the manner in which the lanyard connects to the cap. The holder member (usually a lanyard) connects by extending through an aperture in a cap. A length of lanyard is extended through the aperture so that a loop is formed. The loop is then wrapped around a groove formed in the cap after passing through the aperture. The frictional engagement between the lanyard, the aperture and the groove locks and fixes the relative position of the lanyard and the cap. This fixed positioning keeps the cap from sliding along the lanyard which keeps the cap in the proper position so that it is generally in the same place on the user's body.

Another feature of the invention is that it permits a one-handed engagement to engage and disengage the pen from the cap member. This improves over many known prior art pens that employ a snap fit or friction fit between the cap and pen body, which require two hands to rejoin the components. This one handed engagement and disengagement is very convenient for persons such as nurses who might be holding a clipboard or computer in one hand and the pen in the other hand.

Another interesting feature of the present invention is that the magnets in the pen itself will permit the pen to be stored by placing it against something magnetic, or a magnetized surface such as a refrigerator door, file cabinet, or metal door frames.

Additionally, the ink barrel can be replaced by a non-ink containing barrel for use in a pointer or touch screen stylus. Such stylii are used, for example by medical practitioners for entering patient data into computerized systems that use touchscreen PDAs or touch type tablet-like computers where data is entered by striking the screen with a stylus.

These and other features of the present invention will become apparent to those skilled in the art upon a review of the drawings and description discussed below, that represent the best mode of practicing the invention perceived presently by the Applicant.

V. BRIEF DESCRIPTION OF DRAWINGS

VI. DETAILED DESCRIPTION

Figure 1:
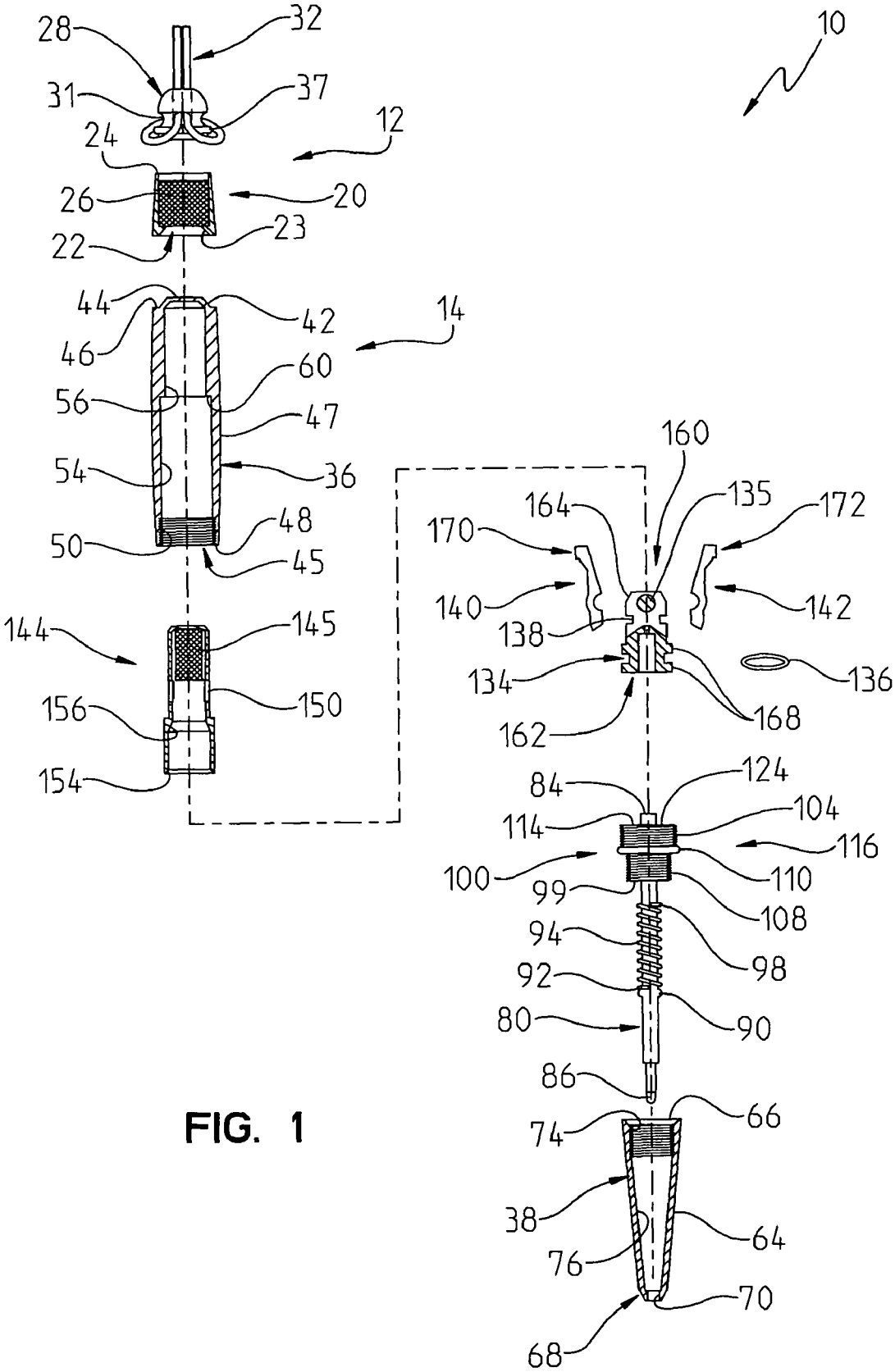
FIG. 1 is an exploded, partially sectional view of the magnetically actuable retractable writing instrument of the present invention.

A magnetically actuable retractable writing instrument, such as a pen 10 of the present invention is shown in FIGS. 1-13. Although the device 10 will be described herein as a ball point type pen, the device 10 can also be an alternate type writing instrument, such as a gel pen, fountain pen, etc. Additionally, the device can be configured as a stylus, wherein there is no ink dispensed from the device 10 or as a mechanical pencil. Such a non-ink type dispensing stylus would have great utility in connection with in-putting data into a touch screen electronic device such as a tablet PC, PDA or the like.

The ball point type pen 10 shown in the figures includes a generally proximally disposed holder portion 12, and a separable distally disposed pen portion 14. The holder portion 12 includes a proximal end cap 28 that is coupled to a magnet holding housing 20. The magnet holding housing 20 is generally cup-shaped, and includes a closed base end 22 that includes a beveled "frusto-conical" sided 23 recess, and an open top or proximal end 24. A magnet 26 is placed within the formerly hollow interior of the magnet holding housing 20, and the proximal cap 28 is placed over the open top of the magnetic holding housing, and is preferably bonded to the magnet holding housing 20 and magnet 26 by some bonding agent, such as glue, epoxy, sonic welding or the like.

The housing 20 and the cap 28 are formed of two pieces, so that the magnet 26 can be inserted within the interior of the housing 20. After assembly, there is generally no reason to keep the housing 20 and cap 28 separate and therefore they are preferably permanently bonded together. The cap 12 includes an aperture 30 that is positioned axially at the same position as an annular groove 31.

The lanyard 32 is attached to the cap 28 by inserting the lanyard 32 through the aperture 30, and extending enough of the lanyard 32 through the aperture 30, so that the distal end portion 37 of the lanyard 32 that extends through the aperture 30 can be placed to fit within the annular groove 31. This placement of the end portion 37 of the lanyard 32 within the annular groove 31 helps to fixedly position the lanyard 32 with respect to the pen cap 28, so that the relative position of the lanyard 32 and the pen cap 28 resists movement and change. This helps to maintain the pen 10 in the desired position around the user's neck. Preferably, the lanyard 32 should have sufficient length so that with an average sized person, the pen holder 28 will be positioned generally at or near the bottom portion of the user's sternum, when the lanyard 32 is placed around the user's neck.

The pen portion 14 includes a proximal case member 36 and a distal case member 38. A fully assembled pen 10 includes a proximal case member 36 that is disposed adjacent to holder member 12, and a distal case member 38 that is disposed distally of the proximal case member 36. The proximal case member 36 includes a closed proximal end 42 that is sized and configured for mating with the bevel sided 23 receiving cup 22 of the holder member 12. The proximal end 42 of the proximal case member 36 includes a frusto-conical portion 44 that is sized and configured for being received adjacent to the frusto-conical beveled surface 23 of the base 22 of the holder member 10.

Radially extending planar portion 44 is disposed at the upper most proximal end of the proximal casing 36. Proximal casing 36 includes a generally cylindrical outer wall 47 that has a distal end 48 that defines a distal opening 45 that opens into a blind hole type interior passageway.

A set of female threads 50 are disposed adjacent to the distal end 48 and are formed on the interior surface of the casing 36. The interior passageway of the casing 36 includes a cylindrical, relatively enlarged diameter distal portion 54, and a cylindrical, relatively reduced diameter proximal portion 56.

An annular radially extending, axially distally facing shoulder 60 is disposed between the relatively enlarged distal portion 54 and reduced diameter portion 56. The shoulder 60 comprises a part of the locking mechanism of the device, and interacts with and engages the latches 170, 172 of the first 140 and second 142 pivotal locking legs of the retractor assembly 130, as will be discussed in more detail below.

The distal end casing member 38 includes a frusto-conically shaped outer wall 64, an open proximal end 66, and an aperture 70 containing distal end 68. A generally frusto-conically shaped interior passageway 76 extends between the open proximal end 66 and the open distal end 68. The passageway aperture 70 of the open distal end 68 is the aperture 70 through which the colorant dispensing distal end 86 of the ink barrel 80 can pass, when the ink barrel 80 is moving between the retracted and extended (writing) position.

Female threads 74 are formed on the interior surface of the proximal end of the interior passageway 76 of the distal casing 38.

Figure 2:
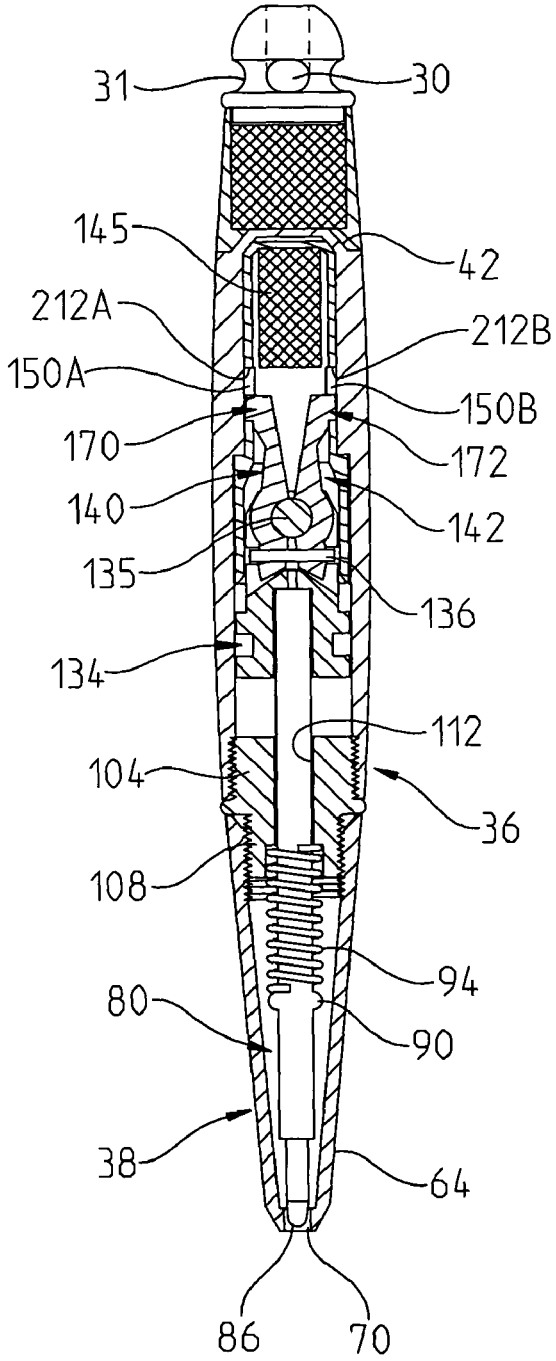
FIG. 2 is a sectional assembled view of the magnetically actuable retractable pen of the present invention, showing the pen in the storage or retracted position.
Figure 3:
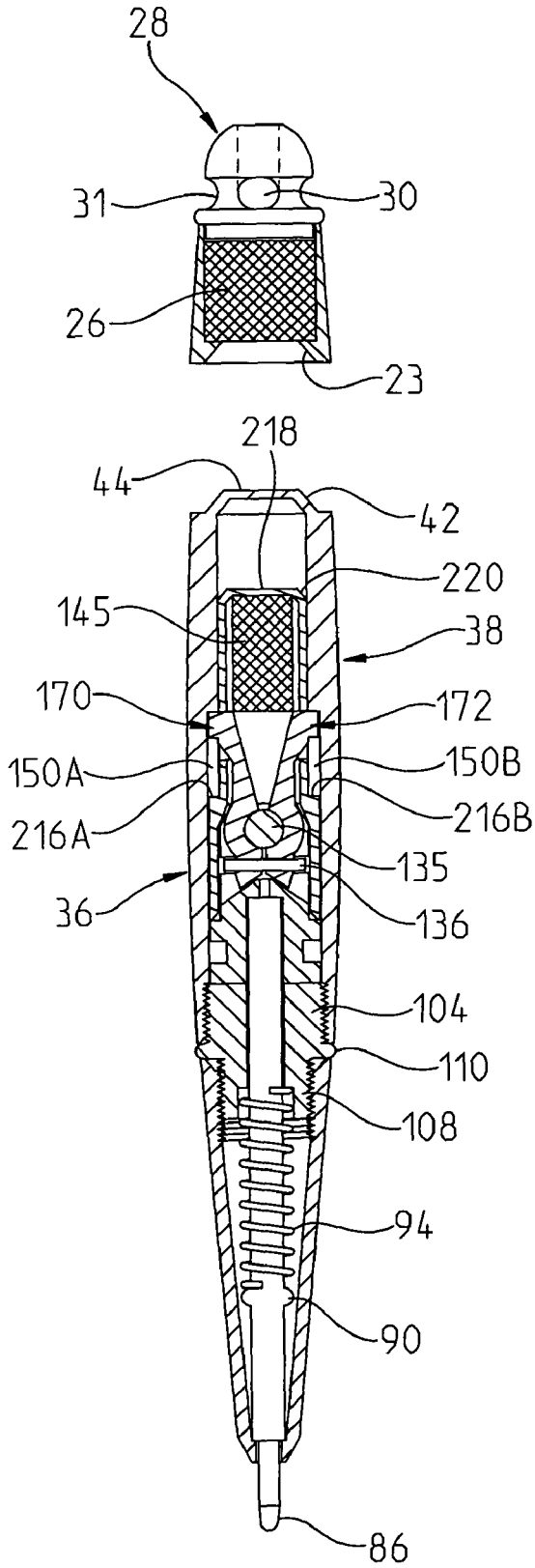
FIG. 3 is a sectional, assembled view of the magnetically actuable retractable pen of the present invention showing the pen in the extended or writing configuration.

The pen includes a generally cylindrical ink barrel 80. The ink barrel 80 is moveable between a retracted position as shown in FIG. 2, wherein the entire ink barrel is contained within casing portions 36, 38, and a extended or writing position, such as is shown in FIG. 3, wherein the colorant dispensing distal end 86 of the ink barrel 80 extends through the passageway distal aperture 70, so that the distal end 86 is disposed exteriorly of the distal casing portion 38.

As also discussed above, the ink barrel 80 need not contain ink. For example, the ink barrel 80 can comprise a non-ink bearing stylus of the type that might be used for entering data on to a touch screen of a PDA, tablet computer, telephone or other touch screen-containing electronic device. Alternately, the ink barrel can contain a pencil lead material.

The ink barrel 80 is generally cylindrical in configuration, and includes a hollow interior in which the ink is stored. The ink barrel 80 includes an open proximal end 84, and a colorant-dispensing member, such as an ink dispensing ball 86 at the distal end.

In order for the ink to flow properly through the barrel 80 and through the ink-dispensing ball 86, it is important that the proximal end 84 be open to atmosphere in order to allow ambient air pressure to exert force on the ink contained within the barrel 80. As such, not only must the proximal end 84 of the barrel 80 remain open, but the device itself including the retractor mechanism should be designed so as not to prevent air from entering through the open proximal end 84 of the barrel 80.

The ink-dispensing member 86 is shown as a ball, similar to the type found in most ballpoint type pens. Ball 86 can be configured for dispensing regular ballpoint ink type ink, or also gel type ink. Additionally, a different type of dispensing member, such as a fountain pen type nib, soft point, or the like can be used in place of the ink dispensing ball 86. Also as discussed above, distal end 86 might comprise nothing more than a closed solid piece of plastic or metal, which serves as a touchscreen-engaging stylus that does not dispense ink.

The ink barrel 80 also includes an enlarged diameter portion 90. The enlarged diameter portion 90 serves a rest for the distal end 92 of spring 94. The spring 94 spirally surrounds the ink barrel 80. The proximal end 98 of the spring 94 uses the radially extending axially distally facing surface 99 of joinder member 100 as a rest. Spring 94 is preferably biased to urge the ink barrel 80 axially distally from the retracted position (FIG. 2) to the extended writing position as shown in FIG. 3. It will be appreciated by those skilled in the art that this spring 94 works diametrically opposite to the manner in which a conventional spring within a ballpoint pen operates, as most springs within ballpoint pens are designed to retract the ink barrel to move from the extended position into the retracted position.

A threaded joinder member 100 is provided for joining together the distal case member 38 and the proximal case member 36. The threaded joinder member 100 includes an axially extending central passageway through which the generally proximal end portion of the ink barrel 80 can pass. This central passageway is sized to have a diameter that is slightly larger than the diameter of the ink barrel 80, so that the central aperture can serve as a guide way for the ink barrel 80, to maintain the ink barrel in its appropriate vertical orientation.

The thread joinder member 100 includes a male threaded proximal portion 104, and a male threaded distal portion 108. The male threads of the male threaded proximal portion 104 are sized and positioned to engage the female threads 74 of the proximal case member 36. Similarly, the male threads of the distal threaded portion 108 are sized and configured for engaging the female threads 74 that are disposed at the proximal end of the distal case member 38.

An intermediate portion 110 is disposed between the proximal 104 and distal 108 threaded portions. The intermediate portion 110 is preferably non-threaded, and has a relatively enlarged diameter. The diameter of the middle portion 110 should generally be equal to the diameter of the outer cylindrical wall 47 of the proximal case member 36, at a position adjacent the distal end 48 of the proximal casing 36.

Although the axial extending passageway is not shown, per se in the figures, it is positioned and can generally be approximated by viewing the position and diameter of the proximal portion of the ink barrel 80 at the point, close to the proximal end thereof, where it passes through the joinder member 100.

The joinder member 100 also includes an axially extending central passageway 112 (FIG. 2), that extends through the entire extent of the threaded joinder member 100. The threaded joinder member 100 further includes a radially extending, axially facing proximal surface 114, that is generally disposed in a parallel plane with the axially distally facing radially extending distal surface 99.

Retractor assembly 130 consists of five primary components: a base member 134; an o-ring member 136; a first pivotable locking leg 140; a second pivotable locking leg 142; and a retractor housing that also serves as an internal magnet tube 144.

The base member 134 includes a proximal portion 160 and a distal portion 162. A radially extending pivot stud 135 is formed in the proximal portion 160, and extends radially outwardly therefrom. The pivot stud 135 provides a pivot point about which the first and second locking legs 140, 142 can pivotally move.

A groove 138 is provided for receiving and properly positioning o-ring 136. As will be discussed in more detail below, the o-ring 136 serves primarily as a rubber band type compression agent for holding the first and second pivot legs 140, 142 on the pivot stud 135, and also for squeezing together the lower (distal) portions of the first and second pivotable locking legs 140, 142. This squeezing normally places the proximal portions 170, 172 of the respective first and second locking legs 140, 142 in a 'spread apart' orientation, that causes the locking legs 140, 142 to position their proximal portion latches 170, 172 radially outwardly in the locking orientation, such as is shown in FIG. 3. This locking orientation helps to fix the axial position of the ink barrel 80, to prevent axial movement of the ink barrel 80 in a proximal direction, to thereby allow the user to exert pressure in an axially distal direction when pressing the barrel point 86 against a writing surface (e.g. paper), when the user is writing.

The proximal portion 160 also includes a beveled end 164, which facilitates axial proximal movement of the base member 134 within the casing and internal magnet tube 144. The distal portion 162 includes a pair of separated annular enlarged diameter positioning portions 168. The radius of the positioning portions 168 are sized to permit the base portion 134 to be slidably received within the retractor housing (internal magnet tube 144) (FIG. 6).

The base member 134 also includes an axially extending, distally opening, barrel receiving passageway 176 for receiving the proximal open end 84 of the ink barrel 80 therein. The barrel receiving passageway 176 (FIG. 6) includes a radially extending end surface 178, which limits the axial extent of movement of the barrel 80 within the axially extending distally opening barrel receiving passageway 176. An axially extending vent tube 180 extends axially proximally from the radially extending end surface 178, and provides a vent for air, so that the air pressure experienced by the open end 84 of the barrel 80 is approximately identical to the ambient air pressure of the environment in which the pen 10 is used.

By keeping this air pressure at approximately ambient air pressure, the flow of ink out of the barrel is fostered. Preventing the flow of air to the end of the barrel 80 would create a vacuum within the interior of the proximal portion of the ink barrel, which would prevent ink from flowing out of the barrel when writing occurs. As such, it is important to maintain a vent opening, so that the air pressure on the proximal end of the ink reservoir remains at a level close to ambient air pressure, approximately equal to the air pressure experienced by the distal ink dispensing end 86 of the barrel 80.

Figure 6:
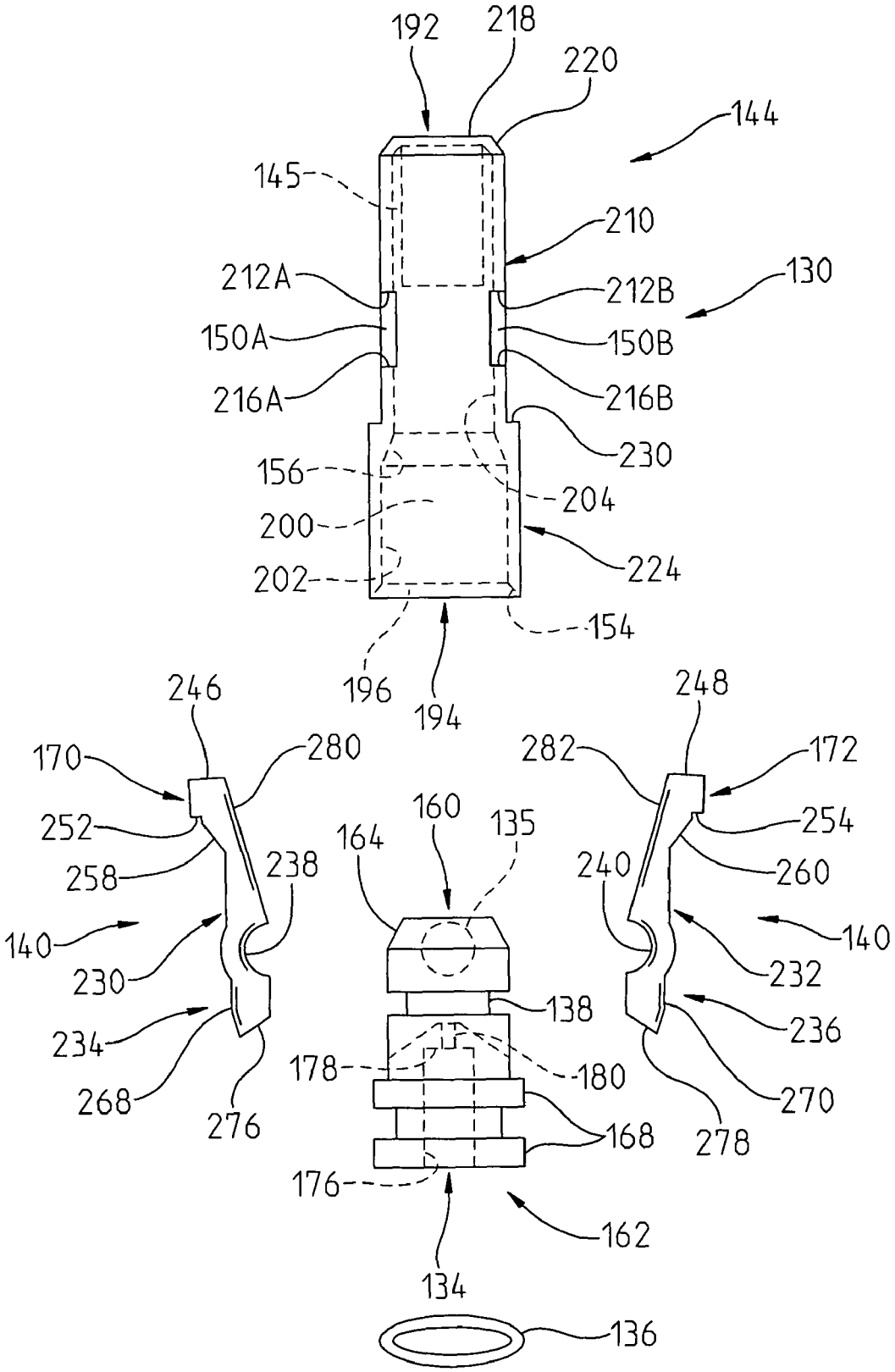
FIG. 6 is an enlarged exploded view of the primary components of the retractor assembly.
Figure 7:
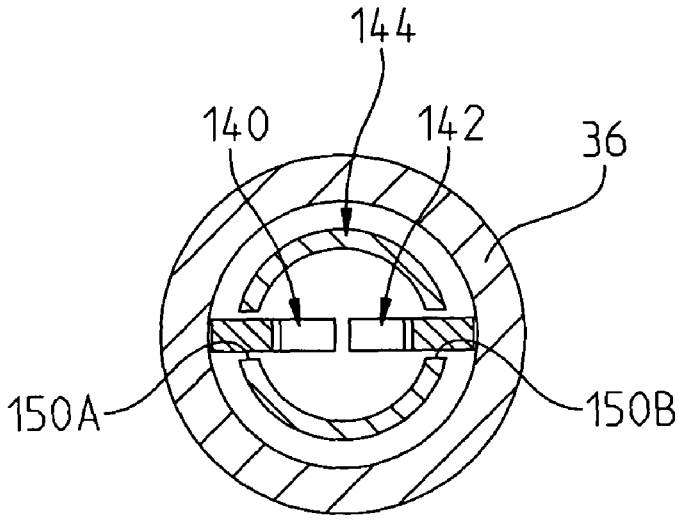
FIG. 7 is a sectional view taken along lines 7-7.
Figure 8:
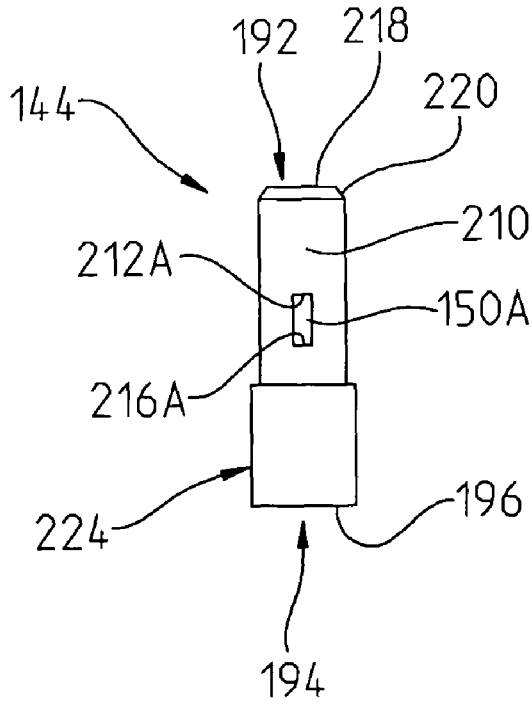
FIG. 8 is a side plan view of a retractor housing (magnet tube) of the present invention.

The axially moveable internal magnet holder 144 is best shown in FIGS. 1, 6, and 8 and includes a proximal end portion 192 that is disposed relatively nearer to holder member 12, and a distal end portion 194, which is disposed relatively nearer to lower casing 38. The magnet holder 144 includes a distal opening 196, which opens into a central passageway 200. The central passageway 200 includes a relatively enlarged diameter distal portion 202 and a relatively reduced diameter proximal portion 204. The proximal portion serves as a housing for a magnet 145. The relatively enlarged diameter distal portion 202 and relatively reduced diameter proximal portion 204 meet at a frusto-conical portion 156, and the distal portion 202 terminates at a beveled distal lip portion 154. The frusto-conical portion 156 is sized and configured to receive the proximal portion 160 including the frusto-conical surface 164 of the face member 134 of the retractor assembly 134.

First and second latch receiving apertures 150A, 150B are formed in the cylindrical wall 210 of the reduced diameter portion of the magnet containing tube 144. The first and second apertures 150A, 150B, each include a proximal shelf 212A, 212B, respectively, and a distal shelf 216A, 216B respectively. The proximal shelves 212A, 212B define the proximal end of the respective apertures 150A, 150B. Similarly, the distal shelves 216A, 216B define the distal end of the latch receiving apertures 150A, 150B.

The shelves 212A, 212B, 216A, 216B play a significant role in the extension and retraction of the ink barrel 80. For example, when the pen 10 is in its retracted position (FIGS. 2 and 9), the proximal latch portions 170, 172 of the locking legs 140, 142 engage the respective distal shelves 216A, 216B. The engagement between the latches 170, 172 and the distal shelves 216A, 216B causes the ink barrel 80 to move axially proximally toward the holder 12, to thereby retract the barrel 80 of the pen 10.

Figure 5:
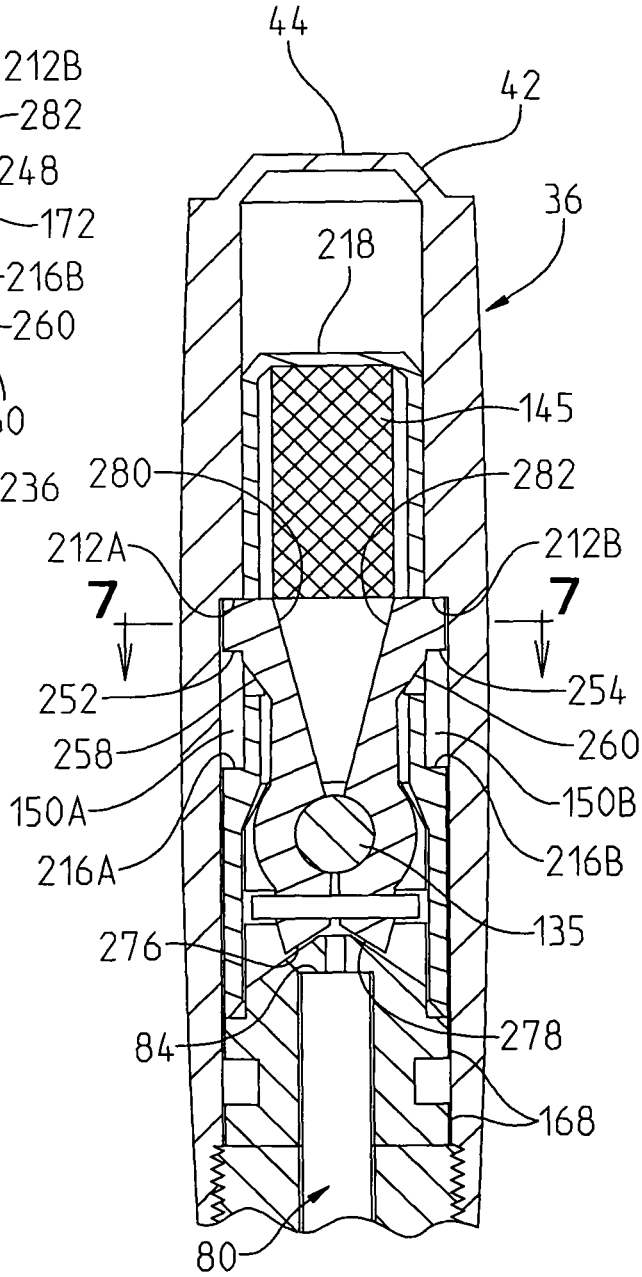
FIG. 5 is an enlarged sectional view, showing the retractor assembly of the pen in the extended or writing configuration, similar to FIG. 3.
Figure 10:
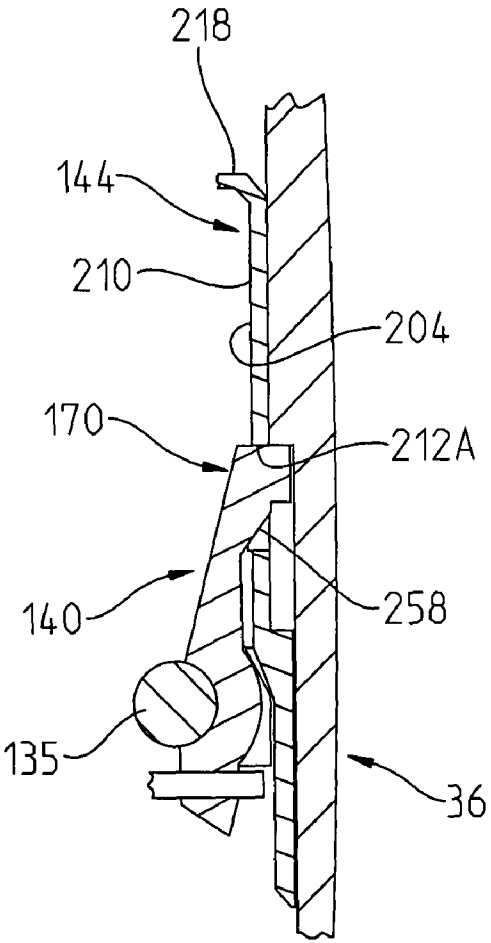
FIG. 10 is a schematic view similar to FIG. 9, showing the pivotable leg, magnet tube and casing in a fully extended position.

Similarly, when the pen 10 barrel 80 is moved into its writing position as shown in FIGS. 3, 5 and 10, the proximal latch portions 170, 172 of the aperture engaging locking legs 140, 142 engage the proximal shelves 212A, 212B of the apertures 150A, 150B respectively. This engagement helps to exert a downward axial pressure on the pivotable legs 140, 142 that, through their connection and attachment to the base 134, and the base's connection with the proximal end 84 of the ink barrel 80, causes the ink barrel 80 to move axially distally, so that the ink dispensing, distal end point 86 extends through aperture 70 and into the writing position. Additionally, by enabling the proximal leg portions latches 170, 172, to extend through the apertures 150A, 150B the proximal latches 170, 172 engage the distal facing annular shoulder 60 of casing 36, to thereby prevent axially proximally directed movement of the legs 140, 142, and hence the base and ink barrel 80. This thereby maintains the ink dispensing port 86 of the barrel in the writing position.

The proximal end 192 of the magnet containing tube 144 includes a radially extending, axially proximally facing planar portion 218, and a frusto-conically shaped beveled portion 220. The magnet holder also includes a reduced diameter cylindrical wall 210 that coincides with the proximal portion 204 of the interior passageway, and a relatively enlarged diameter cylindrical wall 224, that coincides in an axial position with the relatively enlarged portion 202 of the interior passageway.

Figure 9:
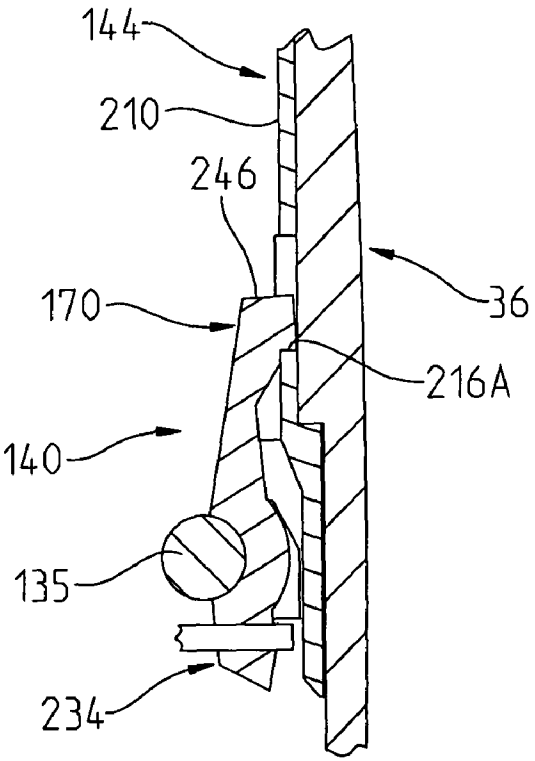
FIG. 9 is a somewhat schematic view showing the latching leg magnet tube and casing when the pen is in the fully retracted position.
Figure 12:
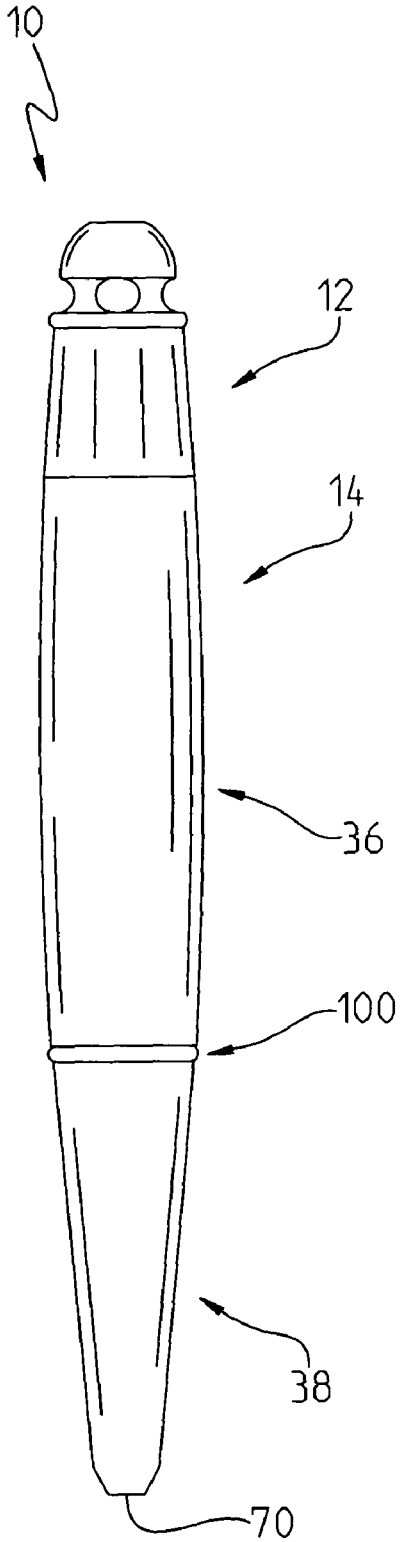
FIG. 12 is a side plan exterior view of the writing instrument of the present invention showing the pen member and holder member coupled together.
Figure 13:
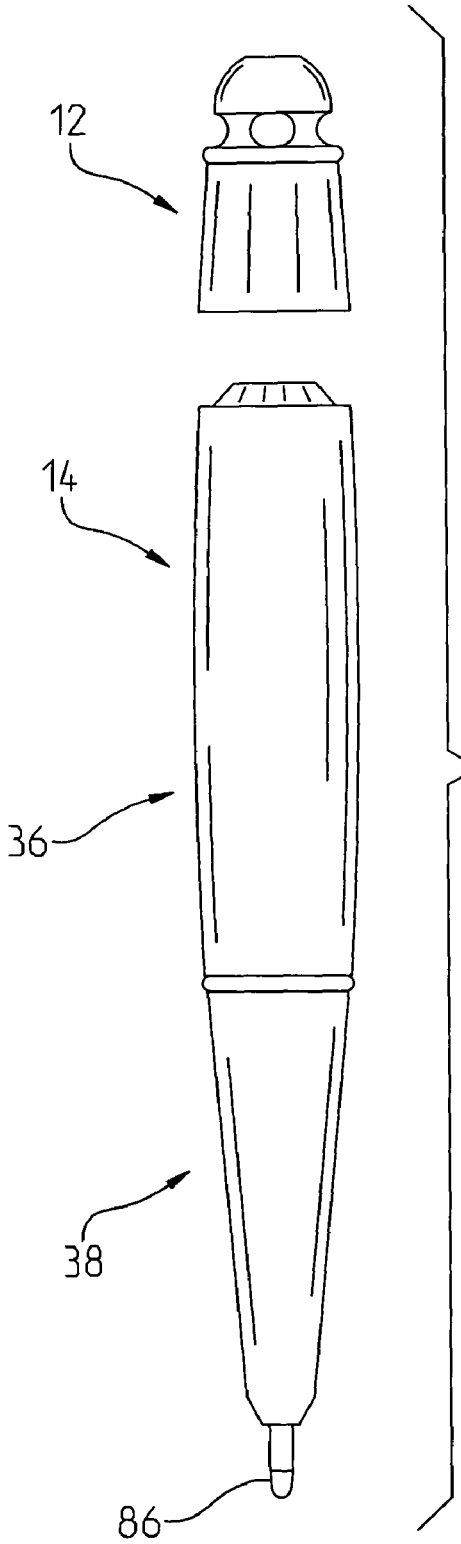
FIG. 13 is an exterior exploded view of the writing instrument of the present invention, showing the holder member separated from the pen member.

The intersection between the reduced diameter cylindrical wall 210 and the enlarged diameter cylindrical wall 224 is a radially extending, axially proximally facing annular shoulder 230. Shoulder 230 is sized and positioned to engage annular shoulder 60 when the magnet containing tube 144 and the pen are in their retracted position as is shown in FIGS. 2, 4 and 9.

The first and second pivotable locking legs 140, 142 are generally identical in configuration, but are positioned relative to each other as mirror images of each other.

Each of the locking legs 140, 142 includes a proximal portion 231, 232 and a distal portion 234, 236 respectively. The proximal portions 231, 232 are generally those portions of the legs 140, 142 respectively that are disposed proximally of the pivot pin 135, and the distal portions 234, 236 are those portions of the locking legs 140, 142 that are disposed generally distally of the pivot pin 135. Each of the legs 140, 142 also includes, on its radially inwardly facing surface, a semicircular pivot pin receiving portion 238, 240 (FIG. 6) respectively.

Figure 4:
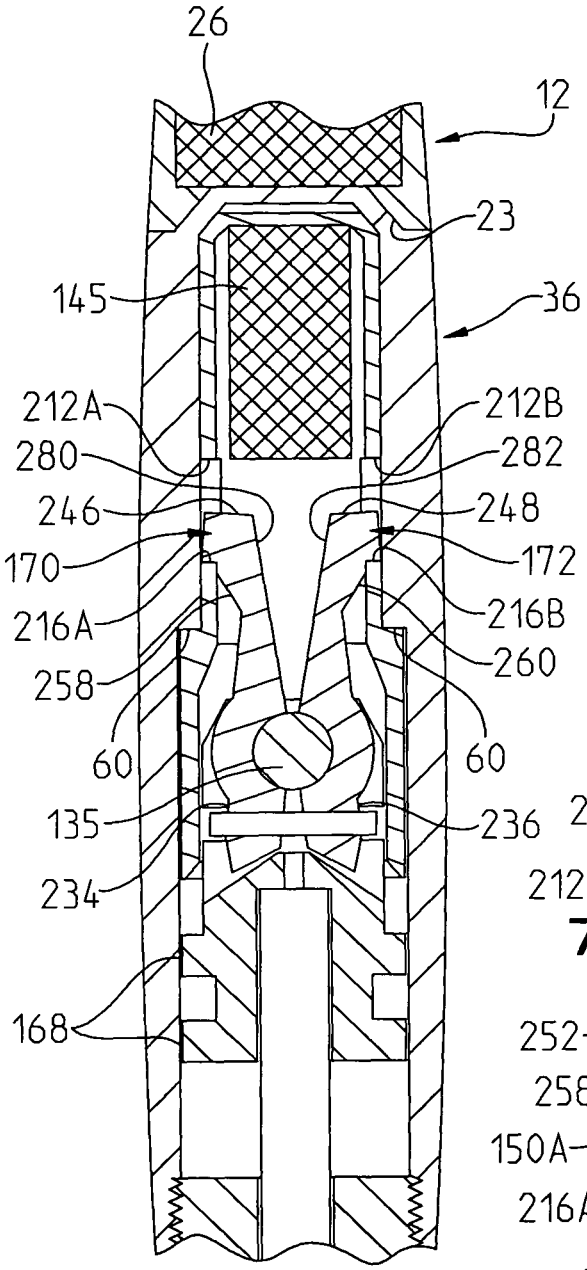
FIG. 4 is an enlarged sectional view, showing the retractor assembly of the pen in the retracted position, similar to FIG. 2.

The pivot pin receiving portions 238, 240 are sized and positioned to engage the pivot pin 135, and are moveable about the pivot pin 135, in an arcuately pivoting direction, between a retracted position, wherein the proximal portions 231, 232 of the legs 140, 142 are relatively close to each other and the distal portions 234, 236 are relatively separated from each other, such as is shown in FIG. 4; and a pen extended position, shown in FIG. 5. In the extended or writing position, the proximal portions 231, 232 are relatively separated from each other, and the distal portions 234, 236 are relatively closer to each other.

The proximal portions 231, 232 of the legs 140, 142 each include a proximal latch portion 170, 172, which is sized and positioned for extending through the apertures 150A, 150B of the internal magnet containing tube 144. The proximal latch portions 170, 172 each include an axially proximally facing, radially extending shoulder engaging surface 246, 248 respectively, which are sized, configured and positioned for engaging the proximally disposed shelves 212A, 212B of the internal magnet containing tube 144, and to also engage the annular shoulder 60 of the casing 36 when the pen is in its extended or writing position as shown in FIG. 3.

The engagement between the axially proximally facing, radially extending shoulder engaging surfaces 246, 248 and the annular shoulder 60, serves as a "lock" to lock the ink barrel 80 in its extended position so that the distal point 86 of the ink barrel is disposed outside of the casing 38. This lock prevents the point 86 from retracting axially proximally, which contributes significantly to the ability of the device 10 serve as a writing instrument, because during the writing operation a user typically will exert a axially directed force in a distal direction to press the pen 10 onto the paper when writing. Without the engagement and locking that results from the engagement of the shoulder engaging surfaces 246, 248 and the annular shoulder 60, the barrel 80 would tend to retract. Because of the locking engagement, this barrel 80 and point 86 retraction does not occur.

The locking legs 140, 142, and in particular the proximal latching portions 170, 172 respectively also include axially distally facing, radially extending surfaces 252, 254 that are sized, positioned and configured for engaging distal shelves 216A, 216B of apertures 150A, 150B. Surfaces 252, 254 are disposed in an opposed relationship to the axially proximally facing shoulder engaging surfaces 246, 248. The axially distally facing shelf engaging surfaces 252, 254 are sized, positioned and configured to engage the distal shelves 216A, 216B when the pen 10 is in the retracted position.

When the pen is moving from the extended position (FIGS. 3, 10) to the retracted position (FIGS. 2, 9), the engagement between the axially distally facing shelf engaging surfaces 252, 254 and the axially distal shelves 216A, 216B helps to pull the legs 140, 142 and hence the base member 134, in an axially proximal direction so that the barrel 80 moves in an axially proximal direction because of the frictional engagement between the proximal portion of the barrel 80 and the base member 134. This pulls the distal tip 86 of the ink barrel 80 to a retracted position within the interior of the casing 38. It should also be noted that this movement is against the force of spring 94 that, because of its bias, naturally tends to push the ink barrel 80 toward the writing or extended position direction by moving the ink barrel axially distally.

The distal portion 234, 236 of each leg 140, 142 includes an o-ring receiving portion 268, 270. The o-ring receiving portion 268, 270 is sized and positioned for receiving the o-ring 136. As discussed above, the o-ring 136 serves primarily as a compressive rubber band, to squeeze together the distal portions 234, 236 of legs 140, 142, so that the distal portions 234, 236 are pivoted relatively closer to each other about pivot point 135, and the proximal portions 231, 232 of the legs 140, 142 are moved relatively apart.

Figure 11:
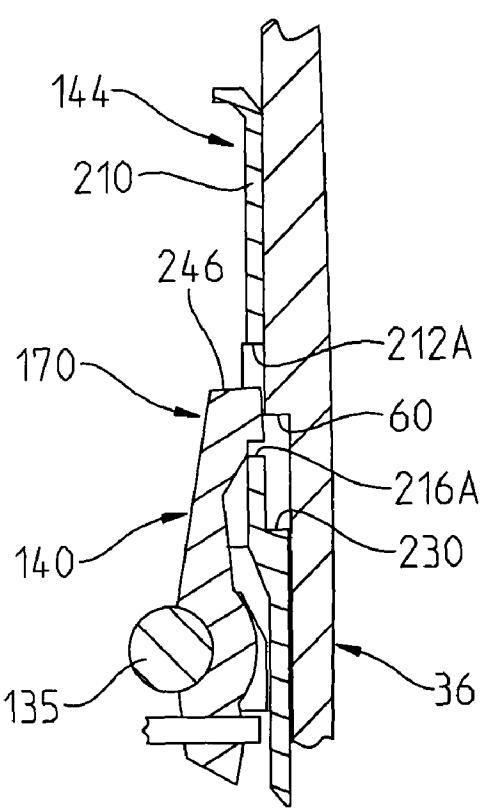
FIG. 11 is a schematic view similar to FIG. 10, showing the pivotable latching leg and magnet tube in an intermediate position during the travel of the pen from its fully extended to fully retracted position.

As best shown in FIG. 11, when the device 10 is moving from the extended position (FIG. 10) to the retracted position (FIG. 9) one thing that must occur is that the proximal portions 231, 232 of the legs 140, 142 must be squeezed together against the force and bias of the o-ring 136, so that the latches 170, 172 will not only be dislodged from their engagement with annual shoulder 60, but will also be moved radially inwardly toward each other, so that they can move axially in the reduced diameter portion 204 of magnet containing tube 144. The diameter of the proximal portion 204 of the interior passageway of the magnet containing tube 144 is less than the diameter to which the latch portions 170, 172 of the legs are usually spread when they are engaged to shoulder 60, and extend a significant radially outward distance through apertures 150A, 150B.

To help facilitate the squeezing together, each of the legs 140, 142 includes an angled, radially inwardly facing surface 258, 260, respectively, that is engageable with the distal aperture ledges 216A, 216B to thereby urge the proximal portions 231, 232 of the legs 140, 142 to pivot about pivot pin 135, so that the proximal portions move toward each other. This pivotal movement causes the latches to become disengaged from annular shoulder 60, so that the legs can move axially proximally. Additionally, legs 140, 142 include an angled, radially inwardly facing surface 280, 282, respectively, to enable the proximal portions 231, 232 to pivot radially inwardly with respect to each other a sufficient amount to permit the latch portions 170, 172 to move inwardly together a sufficient distance to become fully dislodged from the annular shoulder 60.

To enable retraction to occur, the casing 36 of the magnet is mated to the holder 12. This mating results in the attraction of the holder magnet 26 to magnet 145 that is within the internal magnet tube 144. This attraction of magnet 145 to magnet 26 causes magnet 145 to move axially proximally toward magnet 26. This results in the axially proximal movement of the magnet tube 144.

The axial movement of the magnet tube 144 causes the distal shelves 216A, 216B to engage the ramping surfaces 258, 260 of the legs 140, 142. Due to the angle of the ramping surface 258, 260, this engagement of the distal shelves 216A, 216B serves to move the proximal portions 232, 234 of legs 140, 142 radially inwardly, by causing legs 140, 142 to pivot about pivot point 135. This radially inwardly pivoting movement of the proximal portions 230, 232 of the legs dislodges the latches 170, 172 from their engagement with the annular shoulder 60 of the casing.

The continued pull exerted by magnet 26, causes the legs 140, 142, once dislodged, to move axially upwardly. Additionally, as the inner magnet tube 144 moves axially proximally, the distal shelves 216A, 216B engage the underside proximal facing surfaces 252, 254 of the legs, to also help pull the legs, and hence the base 134 and ink barrel 80 in a proximal direction, to thereby cause the barrel 80 to retract. This retraction occurs until proximal end 192 of the inner magnet tube 144 has engaged the underside surface 22 of the proximal end of the proximal casing 36 (FIG. 1) as best shown in FIG. 4 and FIG. 2.

To cause the pen to extend, the opposite action occurs.

The removal of the casing 36 from the holder 12, causes the internal magnet tube 144 to move axially distally, under the expanding influence of the spring 92, which is normally biased to move into its expanded position as shown in FIG. 3. This axially distal movement of the barrel 80 under the influence of spring 92 continues, until the point wherein the base member 134 engages the upper surface 114 of the joinder member 100.

At this position, the latch portions 170, 172 of the legs 140, 142 are disposed opposite to the annular shoulder 60 of the casing 36, whereby the latches 170, 172 can engage the shoulder 60, and more particularly, the proximally facing surfaces 246, 248 of the legs can engage the shoulder 60. In this position, latches 170, 172 lock onto the shoulder 60 to prevent any axially proximal movement of the base 134, and legs 140, 142, and by extension, the barrel 80. This prevention of proximal movement permits the user to exert axially distally directed pressure against the barrel 80 of the type normally encountered when one presses the end 86 of the barrel 80 of the pen 10 against the paper on which the user is writing.

It should also be noted that the distal portions of the legs 140, 142 include angled surfaces 276, 278. These angled surfaces are provided for enabling the legs to better clear the surface of the base member.

Although the above invention has been described in detail with reference to certain preferred embodiments, it will be appreciated by those skilled in the art that variations and modifications can exist within the spirit and scope of the invention, and is limited only by the claims, and by a full range of equivalents thereto.

What is claimed:

1. A magnetically actuated writing instrument comprising a holder portion including a first magnetically attractive member, and a writing instrument portion having an interior and a second magnetically attractive member, the writing instrument portion including a barrel having a distal end portion, the barrel being movable between a retracted position wherein the distal end portion is disposed within the interior of the writing instrument portion, and an extended position wherein the distal end portion is disposed exteriorly of the writing instrument portion, and a retractor for moving the barrel between the retracted and extended positions, the retractor including the first and second magnetically attractive members, and a locking latch member for locking the barrel in an extended position wherein the barrel is prevented from moving to the retracted position, wherein the presence of magnetic attraction between the first magnetically attractive member and the second magnetically attractive member causes the barrel to move toward the retracted position, and the absence of magnetic attraction between the first and second magnetically attractive members causes the barrel to move toward the extended position.

2. The writing instrument of claim 1 where at least one of the first and second magnetically attractive members comprises a magnet.

3. The writing instrument of claim 1 wherein the holder portion is physically separable from the writing instrument portion, wherein separating the holder portion from the writing instrument portion causes the absence of magnetic attraction, and joining the writing instrument portion to the holder portion causes the presence of magnetic attraction between the first and second magnetically attractive members.

4. The writing instrument of claim 1 wherein the locking latch member comprises a radially movable locking latch member.

5. The writing instrument of claim 4 wherein the retractor is disposed in the writing instrument portion, and the writing instrument portion includes a shoulder engagable with the locking latch member, wherein the engagement between the locking latch member and the shoulder locks the barrel into the extended position.

6. The writing instrument of claim 5 wherein the writing instrument includes a proximal casing member and a distal casing member removably coupled to the proximal casing member, and wherein the shoulder comprises a radially extending, shoulder member formed as a part of the proximal casing member.

7. The writing instrument of claim 4 wherein the retractor includes a retractor housing having an interior, wherein the second magnetically attractive member is coupled to the retractor housing.

8. The writing instrument of claim 7 where the retractor includes a base portion coupled to the retractor housing, and wherein the locking member is coupled to the base member.

9. The writing instrument of claim 7 wherein the base portion of the retractor is coupled to the barrel for enabling axial movement of the retractor to cause axial movement of the barrel.

10. The writing instrument of claim 9 further comprising a spring capable of exerting a distally directed force on the barrel for biasing the barrel into the extended position, wherein the distally directed force exertable by the spring to move the barrel toward the extended position, is less than a proximally directed force exerted by an attraction force between the first and second magnetically attractive members to move the barrel toward the retracted position.

11. The writing instrument of claim 7, wherein the locking latch member includes at least one latch member disposed within the interior of the retractor housing, and engagable with a latch engaging member, the retractor housing includes a first aperture, the latch member being radially movable for being extendable through the first aperture, and wherein the first aperture is at least partially defined by a shelf engagable with the locking member for moving the latch member out of engagement with the latch engaging member.

12. The writing instrument of claim 4 wherein the barrel is coupled to the retractor for enabling axial movement of the retractor to cause axial movement of the barrel.

13. The writing instrument of claim 12 wherein the second magnetically attractive member is coupled to the retractor, and the second magnetically attractive member and first magnetically attractive member exert a magnetically attractive force on each other to move the barrel proximally toward the retracted position.

14. The writing instrument of claim 13 further comprising a spring coupled to the barrel, for biasing the barrel distally into the extended position, wherein the distally directed force exerted by the spring to move the barrel toward the extended position is less than the proximally directed magnetically attractive force exerted by the first and second magnet members to move the barrel toward the extended position.

15. The writing instrument of claim 1 wherein the holder includes an end cap and a cap-shaped magnet holding housing for holding the first magnetically attractive member, the end cap and magnet holding housing being joinable for mechanically trapping the magnetically attractive member within the magnet holding housing.

16. A magnetically actuated writing instrument comprising a holder portion including a first magnetically attractive member, and a writing instrument portion having an interior and a second magnetically attractive member, the writing instrument including a barrel having a distal end portion, the barrel being movable between a retracted position wherein the distal end is disposed within the interior of the writing instrument portion, and an extended position wherein the distal portion is disposed exteriorly of the writing instrument portion, and a retractor for moving the barrel between the retracted and extended positions, the retractor including the first and second magnetically attractive members, and a locking member comprising at least one radially movable latch member for locking the barrel in the extended position, wherein the presence of magnetic attraction between the first magnetically attractive member and the second magnetically attractive member causes the barrel to move toward the retracted position, and the absence of magnetic attraction between the first and second magnetically attractive members causes the barrel to move toward the extended position.

17. The writing instrument of claim 16 wherein the locking member includes a pivot member, and the at least one radially movable latch member comprises a pivotal leg member pivotably coupled to the pivot member for pivotable movement of the latch member between a locking position and an unlocked position.

18. The writing instrument of claim 16 wherein the at least one radially movable latch member comprises a first latch member and a second latch member, and the at least one pivotably movable leg member comprises a first pivotably movable leg member including the first radially movable latch member, and a second pivotably movable leg member including the second radially movable latch member, and a biasing member coupled to the first and second pivotably movable leg members for normally biasing the first and second latch members into the locking position.

19. A magnetically actuated writing instrument comprising a holder portion including a first magnetically attractive member, and a writing instrument portion having an interior and a second magnetically attractive member, the writing instrument including a barrel having a distal end portion, the barrel being movable between a retracted position wherein the distal end is disposed within the interior of the writing instrument portion, and an extended position wherein the distal portion is disposed exteriorly of the writing instrument portion, and a retractor for moving the barrel between the retracted and extended positions, the retractor including:

the first and second magnetically attractive members, a locking member for locking the barrel in the extended position a retractor housing having an interior, and a base portion coupled to the retractor housing, and wherein the locking member is coupled to the base portion wherein the second magnetically attractive member is coupled to the retractor housing, wherein the locking member includes at least one latch member disposed within the interior of the retractor housing, the retractor housing includes a first aperture, the latch member being radially movable for being extendable through the first aperture, and wherein the presence of magnetic attraction between the first magnetically attractive member and the second magnetically attractive member causes the barrel to move toward the retracted position, and the absence of magnetic attraction between the first and second magnetically attractive members causes the barrel to move toward the extended position.

20. The writing instrument of claim 19 wherein the locking member includes a pivot member coupled to the base member, and the at least one latch member comprises a pivotal leg member pivotably coupled to the pivot member to permit the latch member to move radially through the first aperture.

21. The writing instrument of claim 20 wherein the writing instrument portion includes a latch engaging shoulder, and the latch member is extendable through the first aperture to engage the latch engaging shoulder to lock the barrel into the extended position.

22. A magnetically actuated writing instrument comprising a holder portion including a first magnetically attractive member, and a writing instrument portion having an interior and a second magnetically attractive member, the writing instrument including a barrel having a distal end portion, the barrel being movable between a retracted position wherein the distal end is disposed within the interior of the writing instrument portion, and an extended position wherein the distal portion is disposed exteriorly of the writing instrument portion, and a retractor for moving the barrel between the retracted and extended positions, the retractor including the first and second magnetically attractive members, and a radially movable locking member for locking the barrel in an extended position wherein the barrel is prevented from moving to the retracted position, wherein the presence of magnetic attraction between the first magnetically attractive member and the second magnetically attractive member causes the barrel to move toward the retracted position, and the absence of magnetic attraction between the first and second magnetically attractive members causes the barrel to move toward the extended position.

* * * * *